US005190261A

United States Patent [19]

Tetting

[11] Patent Number: 5,190,261

[45] Date of Patent: Mar. 2, 1993

[54] ROTATABLE TREE SUPPORT APPARATUS

[76] Inventor: Michael J. Tetting, 105 Wilson Ave. SE., St. Cloud, Minn. 56304

[21] Appl. No.: 837,643

[22] Filed: Feb. 14, 1992

[51] Int. Cl.[5] ..... F16M 13/00

[52] U.S. Cl. ..... 248/522; 211/163; 248/349

[58] Field of Search ..... 248/521, 522, 349, 415, 248/425, 664, 652; 211/163

[56] References Cited

U.S. PATENT DOCUMENTS

| | | | |
|---|---|---|---|
| 1,987,994 | 1/1935 | Doring | 248/522 |
| 2,469,884 | 5/1949 | Masone | 248/521 |
| 2,527,969 | 10/1950 | Siebenkittel | 248/522 X |
| 2,568,995 | 9/1951 | Eckhardt | 248/522 X |
| 2,587,788 | 3/1952 | Tacy | 248/522 |
| 2,847,175 | 8/1958 | Farley | 248/522 X |
| 3,042,350 | 7/1962 | Lencioni | 248/522 X |
| 4,720,140 | 1/1988 | Change | 248/349 X |
| 4,756,500 | 7/1988 | Baker | 248/221.4 X |

*Primary Examiner*—J. Franklin Foss
*Attorney, Agent, or Firm*—Leon Gilden

[57] ABSTRACT

A tree support for receiving a Christmas tree to permit rotation thereof is arranged to include a truncated conical base rotatably mounting a truncated conical rotary head. The rotary head is mounted upon an annular array of bearings mounted within the base, with the base including a transmission plate secured to the base receiving a tubular support shaft therethrough. The tubular support shaft is received to an upper end of a drive motor to effect rotation of the tubular support shaft fixedly secured to the rotary head. The transmission plate is in electrical communication with a plurality of electrical outlets. The transmission plate may be formed of continuous annular electrical tracks, or alternatively of discontinuous annular tracks to effect a twinkling effect of lights and the like mounted to the tree support by the apparatus.

1 Claim, 4 Drawing Sheets

ROTATABLE TREE SUPPORT APPARATUS

BACKGROUND OF THE INVENTION

1. Field of the Invention

The field of invention relates to Christmas tree stands, and more particularly pertains to a new and improved rotatable tree support apparatus wherein the same permits rotation of a Christmas tree, including a truncated conical base rotatably mounting a truncated rotary head.

2. Description of the Prior Art

Christmas tree stands and the like are available in the prior art. Such stand structure is exemplified in the U.S. Pat. No. 3,495,083 to Sporel wherein the stand is formed with multicolored base light members mounted within the base portion.

The U.S. Pat. Nos. 3,591,114 to Beatty and 4,825,586 to Copper are examples of prior art tree stands to stationarily secure a tree thereto.

As such, it may be appreciated there continues to be a need for a new and improved rotatable tree support apparatus as set forth by the instant invention which addresses both the problems of ease of use as well as effectiveness in construction in permitting the rotation of a Christmas tree relative to an underlying support stand and in this respect, the present invention substantially fulfills this need.

SUMMARY OF THE INVENTION

In view of the foregoing disadvantages inherent in the known types of Christmas tree support apparatus now present in the prior art, the present invention provides a rotatable tree support apparatus wherein the same is arranged to rotatably mount a tree, and more specifically a Christmas tree. As such, the general purpose of the present invention, which will be described subsequently in greater detail, is to provide a new and improved rotatable tree support apparatus which has all the advantages of the prior art tree support apparatus and none of the disadvantages.

To attain this, the present invention provides a tree support for receiving a Christmas tree to permit rotation thereof arranged to include a truncated conical base rotatably mounting a truncated conical rotary head. The rotary head is mounted upon an annular array of bearings mounted within the base, with the base including a transmission plate secured to the base receiving a tubular support shaft therethrough. The tubular support shaft is received to an upper end of a drive motor to effect rotation of the tubular support shaft fixedly secured to the rotary head. The transmission plate is in electrical communication with a plurality of electrical outlets. The transmission plate may be formed of continuous annular electrical tracks, or alternatively of discontinuous annular tracks to effect a twinkling effect of lights and the like mounted to the tree support by the apparatus.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved rotatable tree support apparatus which has all the advantages of the prior art tree support apparatus and none of the disadvantages.

It is another object of the present invention to provide a new and improved rotatable tree support apparatus which may be easily and efficiently manufactured and marketed.

It is a further object of the present invention to provide a new and improved rotatable tree support apparatus which is of a durable and reliable construction.

An even further object of the present invention is to provide a new and improved rotatable tree support apparatus which is susceptible of a low cost of manufacture with regard to both materials and labor, and which accordingly is then susceptible of low prices of sale to the consuming public, thereby making such rotatable tree support apparatus economically available to the buying public.

Still yet another object of the present invention is to provide a new and improved rotatable tree support apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
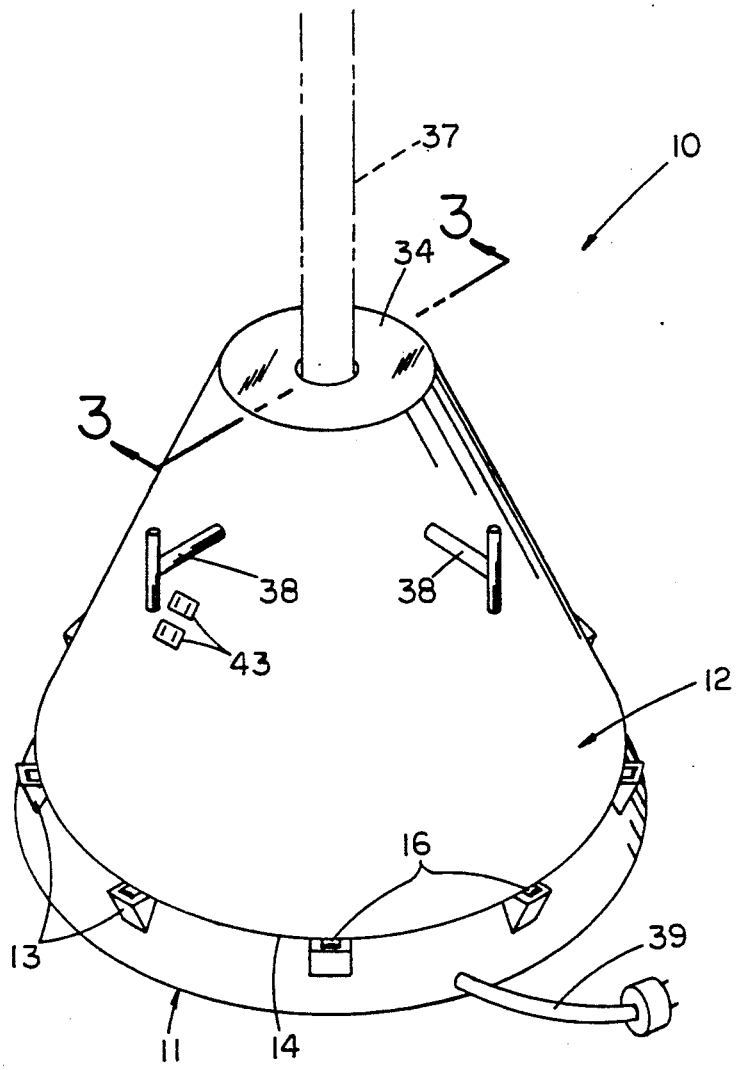
FIG. 1 is an isometric illustration of the instant invention.
Figure 2:
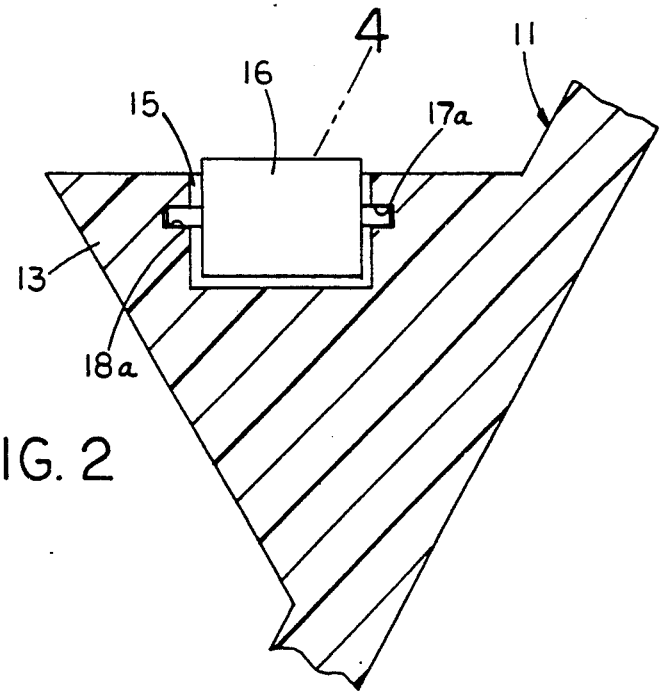
FIG. 2 is an orthographic view of section 2 as set forth in FIG. 3.

With reference now to the drawings, and in particular to FIGS. 1 to 9 thereof, a new and improved rotatably tree support apparatus embodying the principles and concepts of the present invention and generally designated by the reference numeral 10 will be described.

More specifically, the rotatable tree support apparatus 10 of the instant invention essentially comprises a truncated conical base 11 rotatably mounting a truncated conical rotary head 12 thereabout. The truncated conical base 11 supports an annular array of bearing support heads 13 fixedly mounted adjacent a lower end of the base 11 to rotatably support a lower annular end 14 of the rotary head 12. Each of the bearing support heads 13 includes a bearing socket 15, with each bearing socket 15 rotatably mounting a cylindrical roller bearing 16 thereabout. Each of the cylindrical roller bearings is arranged with its axis radially oriented relative to the conical base 11 and the rotary head 12 that are in turn coaxially aligned relative to one another. The cylindrical roller bearings 16 (see FIG. 4) includes a first rigid axle 17 and a second telescoping axle 18 biased exteriorly by a telescoping axle biasing spring 19 positioned within each roller bearing and the second axle. In this manner, the first and second axles 17 and 18 are received within first and second bores 17*a* and 18*a* of each bearing support head 13.

Figure 3:
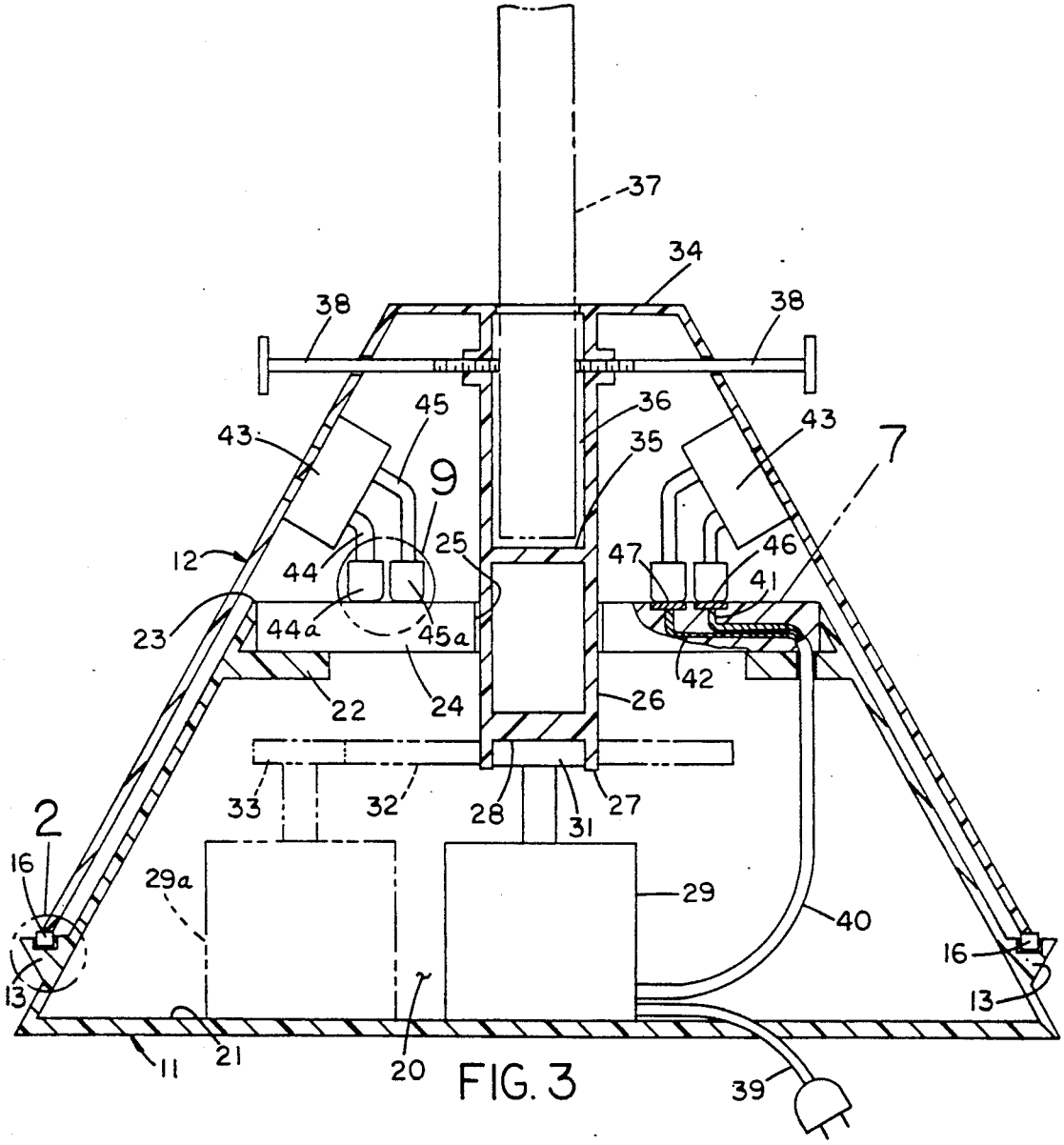
FIG. 3 is an orthographic view, taken along the lines 3—3 of FIG. 1 in the direction indicated by the arrows.
Figure 4:
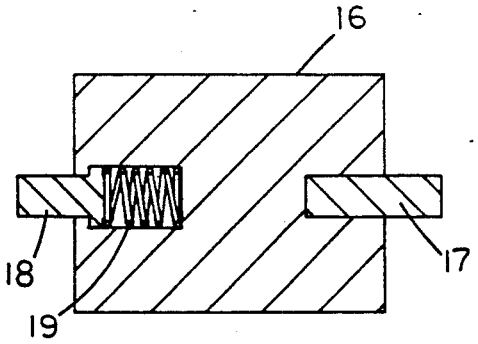
FIG. 4 is an orthographic cross-sectional illustration of the roller bearing, as set forth in FIG. 2.
Figure 5:
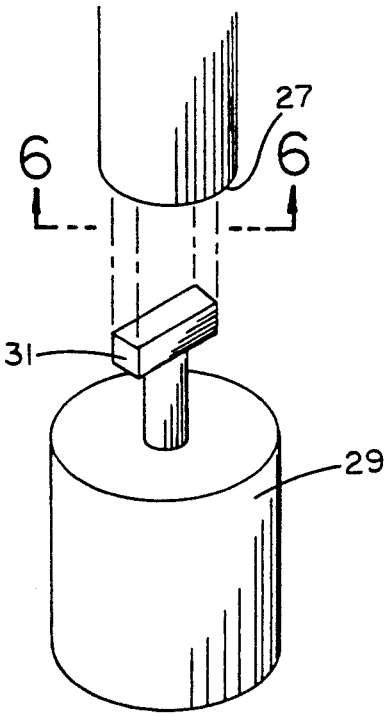
FIG. 5 is an isometric illustration of the drive motor and its orientation relative to the support shaft.
Figure 6:
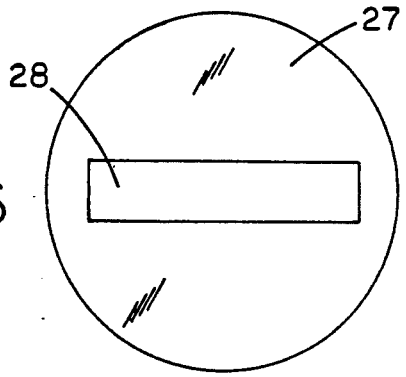
FIG. 6 is an orthographic view, taken along the lines 6—6 of FIG. 5 in the direction indicated by the arrows.

The conical base 11 includes a base cavity 20 formed above a cavity floor 21 that is orthogonally oriented relative to the common axis of the base and rotary head 11 and 12 respectively. An annular flange 22 is fixedly mounted interiorly of the conical base 11 projecting within the base cavity 20, with the annular flange 22 arranged parallel relative to the floor 21 and including an electrical transmission plate 24 formed of insulative material mounted onto the annular flange 22 that is positioned below the base upper annular end 23. The transmission plate includes a transmission plate central bore 25 coaxially aligned relative to the base receiving a tubular support shaft 26 therethrough. The tubular support shaft is coaxially aligned relative to the transmission plate 24, as well as the conical base 11 and the rotary head 12, with the tubular support shaft including a support shaft bottom end 27 formed with a bottom end socket 28 therewithin. A drive motor 29 is mounted to the cavity floor 21 and includes a drive motor output shaft 30, with an output shaft bar 31 fixedly mounted to an upper distal end of the output shaft orthogonally oriented relative to the output shaft. The bar is received within the support shaft socket 28 to fixedly secure the output shaft 30 relative to the support shaft. An auxiliary orientation 29*a* of the drive motor 29 is available, wherein the auxiliary drive motor 29*a* includes a secondary gear 33 mounted to the output shaft bar 31 cooperative with a primary gear 32 that in turn is mounted to the lower distal end of the support shaft 26 to provide for speed reduction and torque multiplication of a tree trunk 37 received within and through the upper distal end of the support shaft 26 within a support shaft upper socket cavity 36, with the tree trunk 37 mounted upon a support shaft intermediate web 35 positioned between the support shaft upper and lower distal ends. It should be noted that the upper distal end of the support shaft 35 is orthogonally oriented relative to the rotary head top wall 34 that is integrally formed to a top end of the rotary head 12. In this manner, rotation of the support shaft 35 effects rotation of the rotary head 12. Further, fastener rods 38 orthogonally oriented relative to the common axis of the conical base 11 and the rotary head 12 is threadedly received through the support shaft 26 into communication with the support shaft upper socket cavity 36. The fastener rods 38 are further slidably received through the truncated conical rotary head 12 to effect securement of the tree trunk 37, in a manner as illustrated in FIG. 3.

Figure 7:
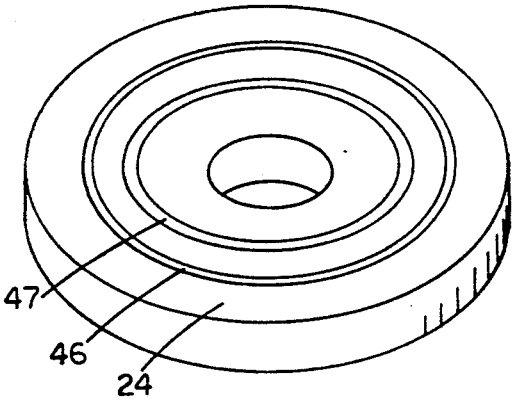
FIG. 7 is an isometric illustration of the transmission plate as set forth in FIG. 3.
Figure 8:
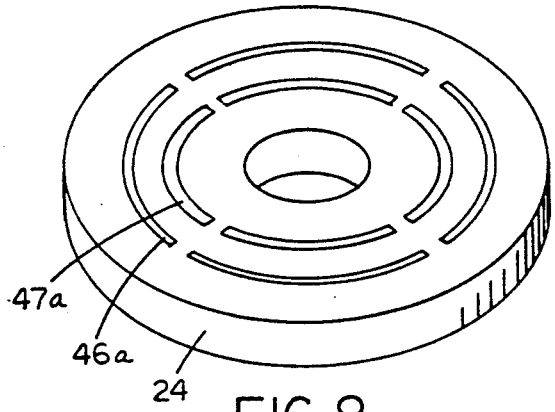
FIG. 8 is an isometric illustration of the transmission plate utilizing discontinuous annular rings.
Figure 9:
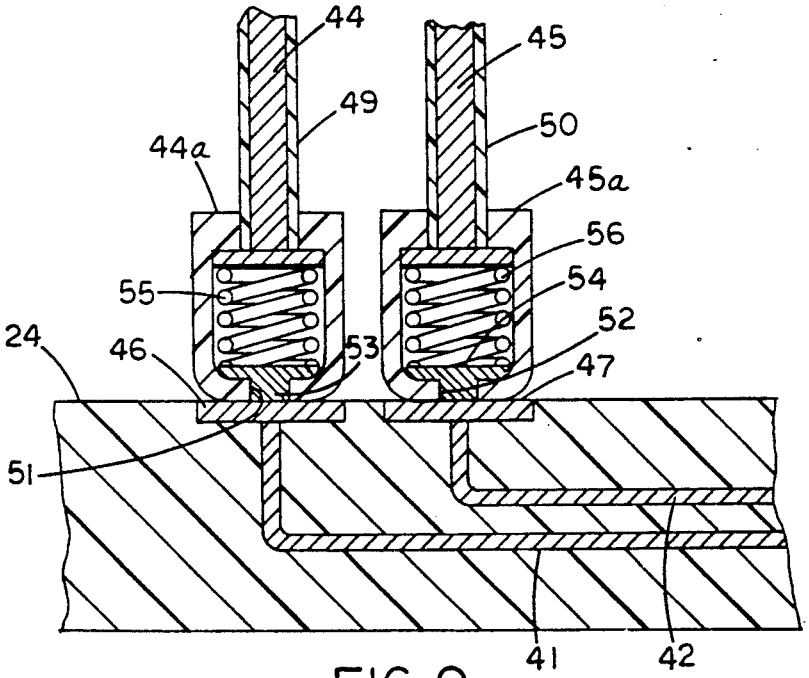
FIG. 9 is an orthographic cross-sectional illustration of section 9 as set forth in FIG. 3.

The electrical transmission plate 24, as illustrated in the FIGS. 7 and 8, may be formed with a respective first and second circular electrical track 46 and 47 or alternatively as illustrated in FIG. 8, a discontinuous first and second circular track 46*a* and 47*a* respectively to effect a twinkling action of illumination bulbs mounted to the tree of the tree trunk 37. An electrically conductive first cable 39 directed into the conical base 11 into a communication with the drive motor 29 is directed by an electrically conductive second cable 40 to the transmission plate 24 (see FIG. 3). The second cable 40 includes a first and second electrical wire 41 and 42 in electrical communication with respective first and second circular electrical conductive track 46 and 47, or alternatively 46*a* and 47*a* of FIG. 8. A plurality of electrical outlets 43 mounted within the rotary head 12 each include a respective first and second contact arm 44 and 45 oriented downwardly and parallel to the common axis of the rotary head 12, with the respective first and second contact arms 44 and 45 including a respective first and second respective shoe 44*a* and 45*a* in communication with the first and second circular electrical tracks 46 and 47 concentrically formed about the common axis. With specific reference to FIG. 9, the first and second shoes 44*a* and 45*a* each include a respective first and second shoe floor opening 51 and 52 receiving a respective first and second contact lug 53 and 54 of electrically communicative material in electrical communication with respective first and second circular tracks 46 and 47. A respective first and second shoe spring 55 and 56 in electrical communication between the first and second contact arms 44 and 45 direct electrical energy to the outlets 43. As illustrated, first and second contact arm polymeric sheaths 49 and 50, as well as the shoes 44*a* and 45*a*, are formed of a polymeric insulative material, with the contact lugs 53 and 54 maintaining a biased electrical communication with the circular tracks to minimize friction and insure electrical communication of the outlets relative to the electrically conductive cables 39 and 40.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A rotatable tree support apparatus, comprising, a truncated conical base, the truncated conical base including a truncated conical rotary head mounted over the truncated conical base coaxially aligned with the truncated conical base about a common axis, and the rotary head including a rotary head top wall fixedly mounted to an upper end of the rotary head orthogonally oriented relative to the common axis, and the rotary head top wall including a tubular support shaft fixedly and orthogonally mounted relative to the rotary head top wall extending below the rotary head top wall, including a support shaft socket directed through the rotary head top wall for receiving a tree trunk therewithin, and the support shaft socket includes an intermediate web mounted medially of the support shaft and orthogonally oriented relative to the common axis, with the support shaft coaxially aligned relative to the common axis and coincident therewith, and the support shaft including a support shaft bottom end wall, the bottom end wall including a bottom end socket, and a drive motor positioned below the bottom end, the drive motor including an output shaft, the output shaft including an output shaft bar fixedly mounted to an upper distal end of the output shaft, and the output shaft bar received within the bottom end socket, and an electrical conductive first cable directed through the conical base in electrical communication with the drive motor, and the truncated conical base includes a cavity therewithin, the base cavity including a base cavity floor, and the base cavity floor orthogonally oriented relative to the common axis, and an array of bearing support heads fixedly mounted to an exterior wall of the conical base, with the bearing support heads spaced above the cavity floor, and each of the support heads including a bearing socket therewithin, and each bearing socket including a cylindrical roller bearing rotatably mounted therewithin, and each bearing socket includes a first axle bore coaxially aligned with the second axle bore, the first axle bore and the second axle bore are radially oriented relative to the common axis, and each cylindrical roller bearing includes the rigid axle received within the first axle bore and a second telescoping axle telesolpingly mounted within the roller bearing, wherein the second telescoping axle includes a biasing spring positioned within the roller bearing to bias the second telscoping axle exteriorly of said roller bearing, and the conical base includes a base upper annular end and annular flange mounted within the conical base projecting into the base cavity concentric relative to the common axis and parallel and spaced above the cavity floor, with the annular flange mounting an electrical transmission plate between the annular flange and the base upper annular end, the transmission plate including a transmission plate central bore coaxially aligned relative to the common axis and rotatably receiving the support shaft therethrough, and at least one electrical outlet directed through the rotary head, and the electrical transmission plate including a first circular electrical track and a second circular electrical track concentric relative to the first circular electrical track and positioned interiorly of the first circular electrical track, wherein the first circular electrical track and the second circular electrical track are concentric relative to the common axis and mounted within the electrical transmission plate, and an electrically conductive second cable in electrical communication with the electrically conductive first cable directed to the electrical transmission plate, and the electrical conductive second cable includes a first electrical wire in electrical communication with the first circular electrical track and a second electrical wire in electrical communication with the second circular electrical track, and said electrical outlet including a rigid first contact arm and a rigid second contact arm in electrical communication with the electrical outlet directed downwardly relative to the electrical outlet, with the first contact arm in electrical communication with the first circular electrical track and the second contact arm in electrical communication with the second circular electrical track, and the first circular electrical track, and the second circular electrical track are discontinuous to effect a discontinuous current of electrical energy directed from the first circular electrical track and the second circular electrical track to said electrical outlet, and the first contact arm includes a first shoe mounted at a lower end thereof, and the second contact arm includes a second shoe at a lower distal end of the second contact arm, the first shoe and the second shoe each include a respective first shoe floor opening and a second floor shoe opening aligned with the respective first circular electrical track and the second circular electrical track, and a first contact lug directed through the first shoe floor opening and the second shoe floor opening including a second contact lug, wherein the first contact lug and the second contact lug are electrically conductive and are in electrical communication with the respective first circular electrical track and the second circular electrical track, and a first shoe spring mounted between the first contact lug and the first contact arm, and a second shoe spring mounted between the second contact lug and the second contact arm to bias the first contact lug and the second contact lug in electrical communication with the respective first circular electrical track and the second circular electrical track.

* * * * *